US005577324A

United States Patent [19]

Tanaka

[11] Patent Number: 5,577,324

[45] Date of Patent: Nov. 26, 1996

[54] ELECTRIC SHAVER

[75] Inventor: Masanori Tanaka, Matsumoto, Japan

[73] Assignee: Izumi Products Company, Nagano, Japan

[21] Appl. No.: 484,636

[22] Filed: Jun. 7, 1995

[30] Foreign Application Priority Data

Jan. 11, 1995 [JP] Japan ..... 7-002537

[51] Int. Cl.[6] ..... B26B 19/16

[52] U.S. Cl. ..... 30/43.6

[58] Field of Search ..... 30/43, 43.1, 43.2, 30/43.4, 43.5, 43.6, 87, 89

[56] References Cited

U.S. PATENT DOCUMENTS

| | | | |
|---|---|---|---|
| 3,027,635 | 4/1962 | Frith | 30/43.5 |
| 4,910,869 | 3/1990 | Labrijn | 30/43.6 |
| 5,007,168 | 4/1991 | Messinger et al. | 30/43 |
| 5,394,611 | 3/1995 | Okabe et al. | 30/43.6 |

FOREIGN PATENT DOCUMENTS

| | | | |
|---|---|---|---|
| 4314479 | 11/1994 | Germany | 30/43.6 |
| 503715 | 3/1976 | U.S.S.R. | 30/43.5 |

*Primary Examiner*—Hwei-Siu Payer
*Attorney, Agent, or Firm*—Koda and Androlia

[57] ABSTRACT

An electric shaver having a shaver head that can be changed in its orientation so as to conform to the facial configuration. The shaver including a blade holding plate fastened to one end of the shaver housing, and a shaver head supporting member which protrudes outward is installed on the center of this blade holding plate. The apex of the shaver head supporting member contacts a projecting element projecting from the inside of the shaver head, so that the shaver head can pivot in any direction or swivel.

12 Claims, 4 Drawing Sheets

ELECTRIC SHAVER

BACKGROUND OF THE INVENTION

1. Field of the Invention

The present invention relates to an electric shaver.

2. Prior Art

Generally, in electric shavers, inner blades are rotated on the under surface of outer blades, and whiskers are cut by the shearing force between these two blades. In some shavers, a single shaving unit that consists of such inner and outer blades is installed in the shaver head; and there are also shavers in which two or three shaving units of this type are installed in the shaver head. In the shavers having three shaving units, for instance, the shaving units are arranged so as to be at the vertices of an equilateral triangle.

Razors which have three shaver units and therefore three outer blades are constructed so that each of the rotating inner blades and outer blades are depressed inwardly during shaving, thus making it possible to accomplish uniform shaving. Furthermore, there are also shavers in which the amount by which the outer blades are depressed inwardly is adjustable as disclosed in, for example, Japanese Patent Application Publication (Kokoku) No. 62-47553.

In the invention described in this Japanese Patent Application Kokoku No. 62-47553, the shaver head, which is detachable from the shaver head, covers a blade holding plate, and three openings, through which the outer blades of respective shaving units (each comprising an inner blade and an outer blade) protrude from the inside, are formed in the shaver head. In addition, a triangular floating holder which has bearing rings that allow the respective inner blades of the three shaving units to rotate is installed between the blade holding plate and the shaver head. The floating holder is held by springs so that as to be depressed inwardly (or towards the inside of the shaver housing) and then come back to the original position. The amount by which the floating holder is depressed inward is adjustable in this shaver.

The shaving units of this prior art substantially comprise the inner and outer blades installed in the shaver head and are individually depressed, and in addition the amount by which the shaving units are depressed is adjustable. However, the inwardly depression motion of the shaving units alone cannot allow the shaver to conform well to curved surfaces such as the jaw. Accordingly, shavers having a shaver head that can conform well to curved surfaces such as the jaw, etc are in demand, and such a demand is being made for shavers that include only a single shaving unit in the shaver head.

SUMMARY OF THE INVENTION

Accordingly, the main object of the present invention is to provide an electric shaver having a shaver head that can pivot so that the inclination of the shaver head can be altered to conform with the curved surfaces of the face.

The object of the present invention is accomplished by a unique structure for an electric shaver which includes:

a shaver housing provided therein a motor;

a shaver head mounted on the shaver head, the shaving head having shaving units, each being composed of an outer blade and an inner blade that is rotated in close contact with the outer blade from the inside by the motor;

a blade holding plate provided inside one end of the shaver housing;

a shaver head supporting member for supporting the shaver head so that the shaver head can pivot on the blade holding plate;

driving members which rotate by receiving the rotation of the motor;

rotation transmission shafts passing through through-holes formed in the blade holding plate and thus protruding to the other side of the blade holding plate, the rotation transmission shafts being connected at one end to the inner blades so as to rotate the inner blades and also connected at another end to the driving members such that the rotation transmission shaft can pivot, can advance and withdraw a prescribed distance in the axial direction, and is rotated about their own axes by the driving members;

spring members which press the rotation transmission shafts toward the shaving units.

In this structure, the shaver head supporting member is pressed outwardly from the center of the blade holding plate; and the tip end of the supporting member which is in contact with a projecting element projecting from the inner surface of the shaver head so that the shaver head is pivotal about the tip end of the shaver head supporting member.

The shaver head supporting member may be mounted to the blade holding plate via a spring so that the shaver head supporting member can be depressed inwardly or toward the inside of the shaver housing overcoming the driving force of the spring.

In addition, the shaver may include shaver head guides which guide the shaver head to make a pivoting motion. The shaver head guides can be comprised of a plurality of guide grooves, which are formed on the inner surface of the shaver head, and guide pins which are provided in the guide grooves.

Moreover, it is preferable that the guide pins be installed so that the tip ends of the guide pins protrude outward from through-holes made in the blade holding plate by being pressed by a spring, and the projecting parts formed on the inner surface of the shaver head contact the tip ends of the guide pins. As a result, the shaver head is prevented from slipping out of the shaver housing by the pins. When the guide pins are retracted into the through-holes by the shaver head which is pulled outward (or in a direction opposite to the shaver housing) by hand, the shaver head is detached from the shaver housing.

In addition, each of the driving members has a tube member, and a plurality of slits are formed so as to extend in the axial direction of the tube member. Each of the rotation transmission shafts is provided with projections, and these projections are loosely inserted into the slits; and the rotation transmission shafts and the driving members are thus connected to each other in such a manner that the rotation transmission shafts can pivot, can advance and withdraw a prescribed distance in the axial direction, and can be rotated about their own axes by the driving members.

In order to prevent the inner blades from falling out of the shaver, the inner blades can be covered by an inner blade retaining plate which has through-holes through which the rotation transmission shafts pass. The inner blade retaining plate is detachably screw-fastened to the shaver head by means of a head-equipped screw, and that the head part of the head-equipped screw constitute the projecting element of the inner surface of the shaver head.

Furthermore, it is preferable that the outer blades have flanges which protrude outward around their outer circumferences, that through-holes into which the outer blades are inserted be formed in the shaver head, and that the outer blades be held in the shaver head in such a manner that the outer blades are slightly movable in the axial direction of the tube members.

It is also desirable to use an elastic cylinder between the shaver head and the shaver housing. This elastic cylinder may be a bellows-form cover. With this bellows-form cover provided between the shaver head and the shaver housing, the shaver head can pivot in any direction (or swivel) on and relative to the shaver housing.

With the structure described above, shaving is performed with the outer blades of the shaver head pressed against the skin. In this case, since the projecting element located at the center of the undersurface of the shaver head is supported by the shaver head supporting member located at the center of the blade holding plate, the shaver head as a whole can also be depressed inside, so that shaving is performed with even greater conformity to the facial skin.

Furthermore, the pivoting of the shaver head is guided by shaver head guides, and in this case, the rotation transmission shafts also follow the pivoting motion of the inwardly-depressed shaver head. Moreover, since the elastic cylinder which covers the gap between the shaver head and the end of the shaver housing is used, the shaver head can easily be restored to its original position after pivoting.

DETAILED DESCRIPTION OF THE PREFERRED EMBODIMENTS

Preferred embodiments of the present invention will be described in detail below with reference to the accompanying drawings.

Figure 1:
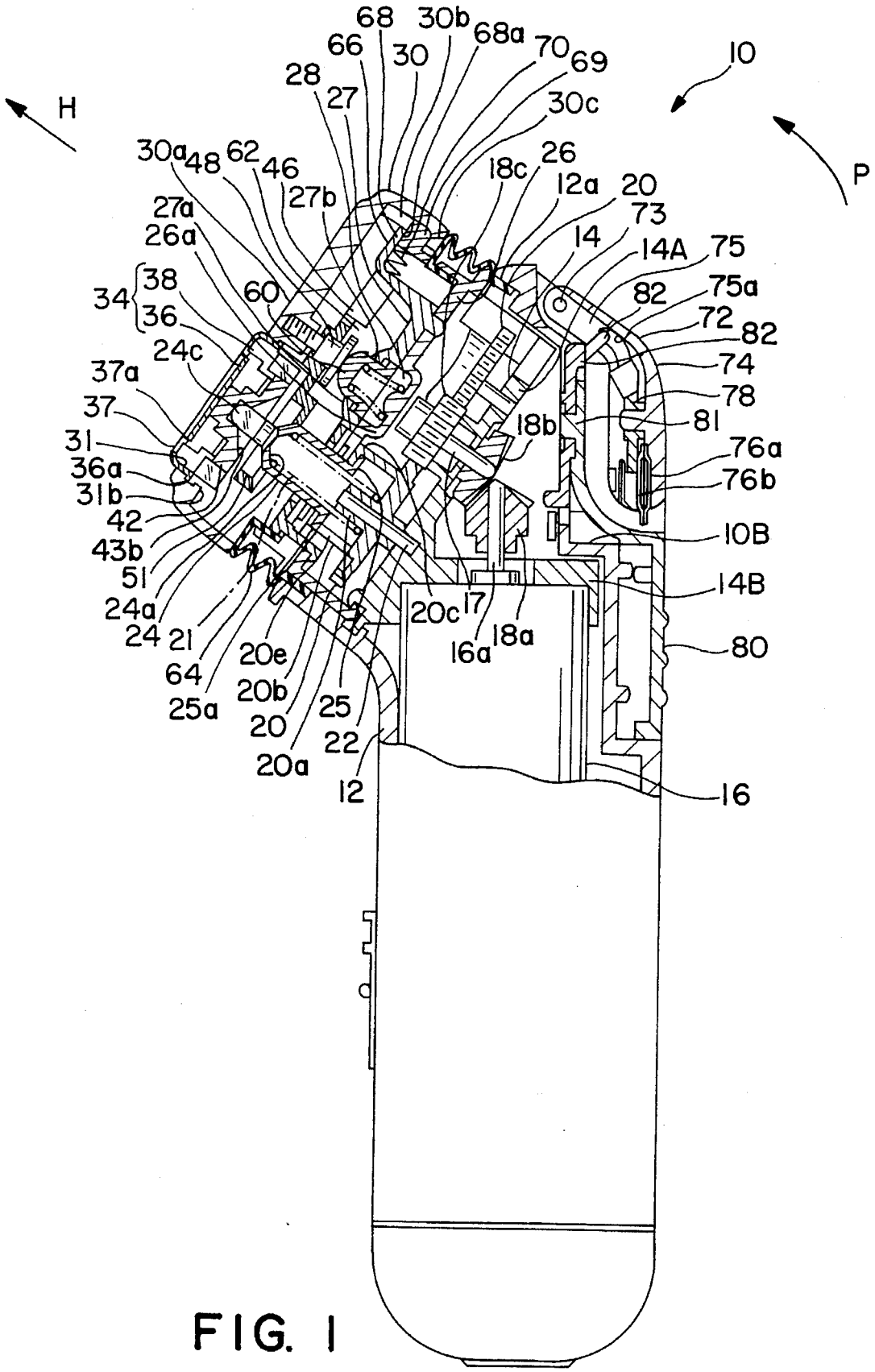
FIG. 1 is a sectional explanatory diagram which illustrates the upper portion of the electric shaver of the present invention.

In FIG. 1, the electric shaver is generally referred to by the numeral 10 and includes a shaver housing 12 and a shaver head 30. The shaver head end of the shaver housing 12 which is at one end (upper end in the Figure) of the shaver housing 12 is open, thus forming an opening 12*a*, and a mounting frame 14 is inserted into this opening 12*a* and secured to the inside of the shaver housing 12.

The mounting frame 14 consists of a frame main body 14A which closes the opening 12*a* and a motor mount 14B which is an integral part of the frame main body 14A. A motor 16 is mounted to this motor mount 14B.

The output shaft 16*a* of the motor 16 extends upward (in the Figure) from the motor mount 14B, and a first bevel gear 18*a* is attached to the tip of this output shaft 16*a*. A second bevel gear 18*b* is attached on the back-side protruding portion of a drive shaft 17 which protrudes from the upper and bottom surfaces of the frame main body 14A. The second bevel gear 18*b* engages with the first bevel gear 18*a* attached on the output shaft 16*a* of the motor 16.

A main gear 18*c* is fastened to the tip of the drive shaft 17. The main gear 18*c* engages with three transmission gears 20 (only two are illustrated in FIG. 1) that are supported on the frame main body 14A of the mounting frame 14 so as to be used as driving members. The transmission gears 20 are positioned so as to be at the vertices of an equilateral triangle when viewed from the top of the shaver 10 (see FIG. 3), and a rotation transmission shaft 24 (which will be described later) is connected to each one of the (three) transmission gears 20.

The three transmission gears 20 and rotation transmission shafts 24 have the same structure; accordingly, the description of the structure of the transmission gears 20 and rotation transmission shafts 24 will be described for only one of these components.

More specifically, a shaft 22 is supported on the frame main body 14A, and the transmission gear 20 has a shaft tube 20*a* that is fitted over the shaft 22. Thus, the transmission gear 20, which is provided with also an outer guide tube 20*b*, is rotatably provided on the shaft 22.

A spring 21 is coiled around the shaft tube 20*a*, and the upper portion of the spring 21 is inserted into the inside 24*a* of the corresponding cylindrical rotation transmission shaft 24 so as to press the rotation transmission shaft 24 upwardly or towards the shaver head 30.

The rotation transmission shaft 24 has an outward flange 25 at the lower end, and three projections 25*a* which project outwardly are formed at equal intervals on the flange 25. These projections 25*a* are loosely inserted into three slits 20*e* (which are oriented in the axial direction) formed in the outer guide tube 20*b* of the transmission gear 20.

As a result, the rotation transmission shaft 24 can advance and withdraw a prescribed distance in the direction of its own axis (or in a direction indicated by arrow H) and also can rotate as a single unit with the transmission gear 20 in the direction of arrow P.

The portions of the flange 25 of the rotation transmission shaft 24 other than the projections 25*a* are located inside the outer guide tube 20*b*, and the flange 25 of the transmission shaft 24 is prevented from slipping out by claws 20*c* formed on the inside wall surface of the guide tube 20*b*.

A first (or lower) blade holding plate 26 which is positionally separated from the mounting frame 14 is installed inside the opening 12*a* of the shaver housing 12. Also, a second (or upper) blade holding plate 27 is installed so that it lies on the first blade holding plate 26. Each of the first and second blade holding plates 26 and 27 is provided with three (3) through-holes arranged at apexes of a triangle so that the rotation transmission shaft 24 protrudes from these through-holes formed in the first and second blade holding plates 26 and 27.

The shaver head 30 is installed in a detachable manner to the second blade holding plate 27 via pins 69 (as will be described later) so as to cover the second blade holding plate 27. Three through-holes 31 are formed in the shaver head 30 so that these through-holes 31 are positioned at the vertices of an equilateral triangle (see FIG. 3). Respective shaving units 34 are located in each of the through-holes 31 from the inside of the shaver housing 12.

Figure 2:
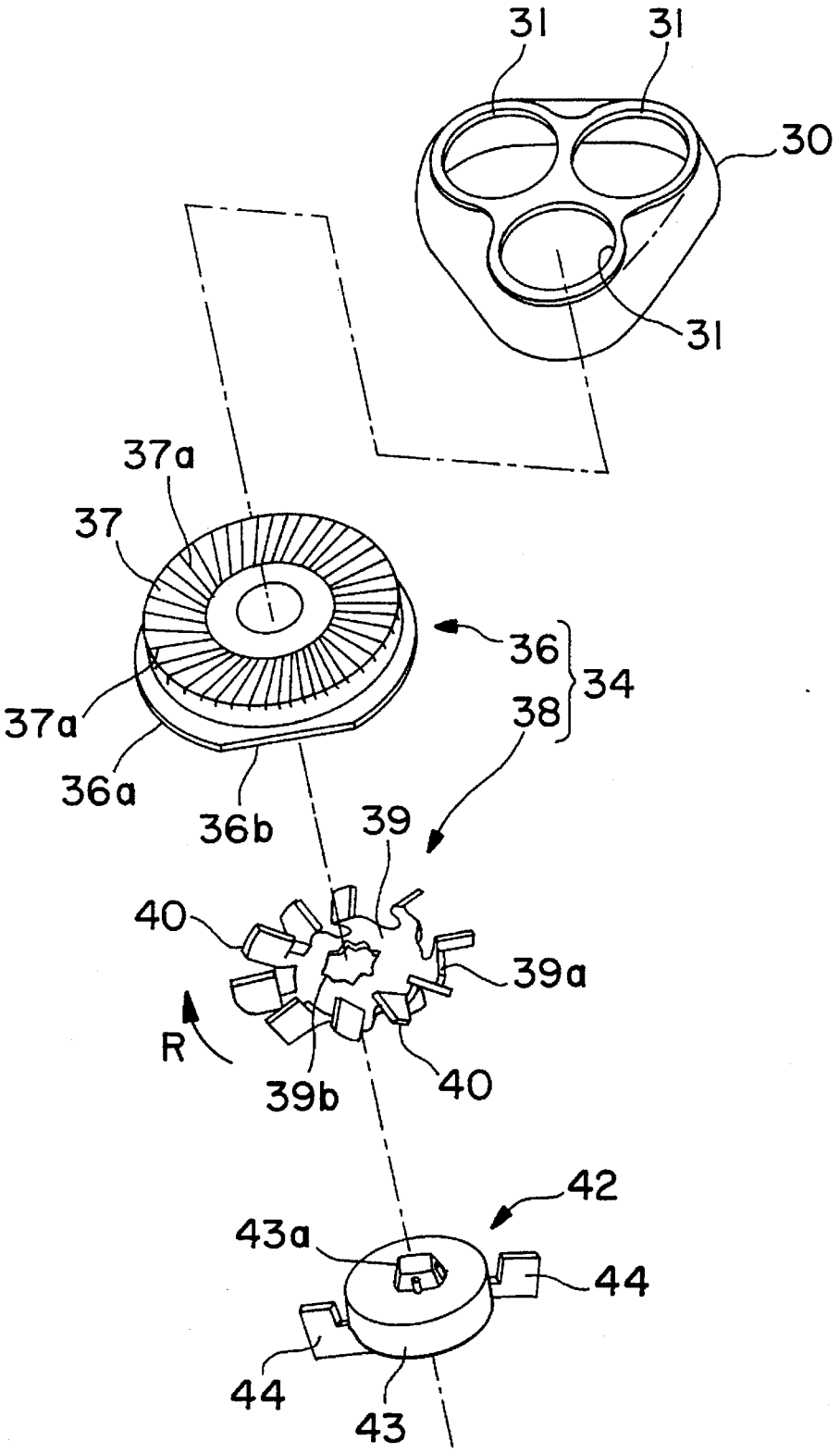
FIG. 2 is an exploded view of one of the shaving units used in the shaver of the present invention.

As best seen in FIG. 2, each of the shaving units 34 consists of an outer blade 36 and an inner blade 38. The outer blade 36 is in a cap-form, having an annular blade surface 37 on the upper or the outside end surface. Radial slits 37*b* are formed throughout the entire blade surface 37.

Figure 3:
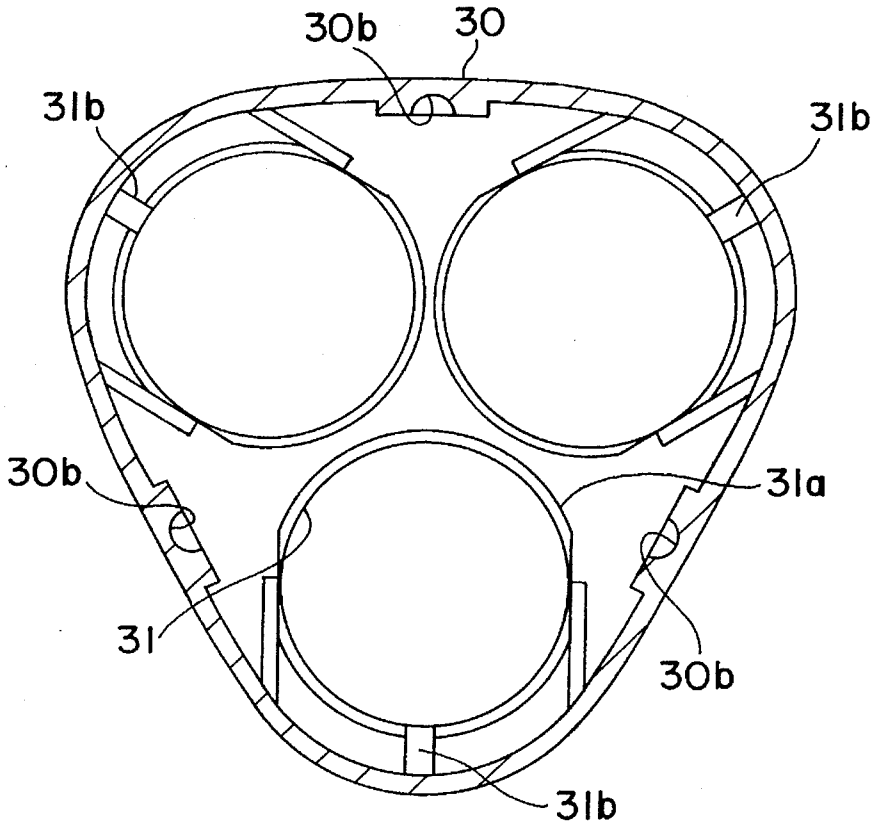
FIG. 3 is bottom view of the shaver head.

Each outer blade 36 is provided with a flange 36*a* at the lower end. The flange 36*a* contacts the rim portion of the corresponding through-hole 31 of the shaver head 30 from the back of the shaver head 30 so that the outer blade 36 is prevented from slipping out. As shown in FIG. 3, a step portion 31*a* is formed in the rim portion of each through-hole 31 of the shaver head 30. Meanwhile, cut-outs 36*b* are formed in portions of the flange 36*a*, and the shape of the step portion 31*a* is formed to be the same as the shape of the flange 36*a*. Accordingly, when the flange 36*a* of the outer blade 36 is fitted into this step portion 31*a*, the outer blade 36 is not rotated.

Figure 4:
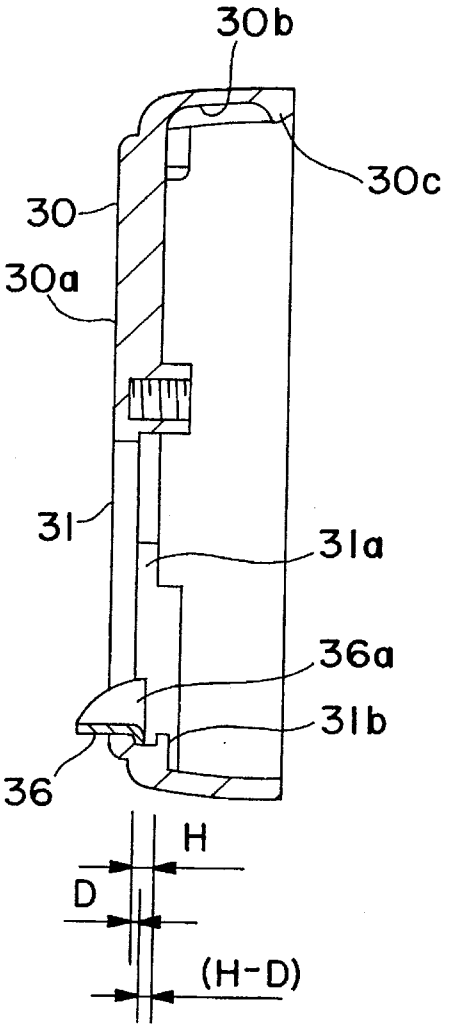
FIG. 4 is a sectional view of the shaver head.

Furthermore, tongues 31*b* extend from the corners of the (substantially triangular shaped) shaver head 30 so that the tongues 31*b* face the step portions 31*a* of the through-holes 31 of the shaver head 30 (see FIGS. 3 and 4). Thus, when the outer blades 36 are set in the shaver head 30, the flanges 36*a* of the outer blades 36 are positioned as inserted in the step portions 31*a* at the positions of the tongues 31*b*.

As seen from FIG. 4, if the depth of the step portions 31*a* of the through-holes 31 of the shaver head 30 is H, and the thickness of the flanges 36*a* of the outer blades 36 is D, then the flanges 36*a* of the outer blades 36 have a play which is equal to H–D by being restrained by the tongues 31*b*. As a result, the outer blades 36 can be depressed inwardly by the distance of H–D.

Each of the inner blades 38 is comprised of a plurality of arms 39*a* that project upwardly from a central disk 39, and cutting blades 40 which slide along the inner surface of the corresponding outer blades 36 are formed on the tips of the arms 39*a*. These cutting blades 40 are inclined in the direction of rotation which is indicated by arrow R in FIG. 2.

The structure of the inner blades 38 will be described in detail with reference to FIGS. 1 and 2.

Each inner blade 38 has an engagement hole 39*b* at the center of the disk 39. This engagement hole 39*b* has a rectangular shape, and a semicircular cut-out is formed in each side of the rectangle hole so that an engaging projection 43*a* of a fan assembly 42 is inserted into the rectangular hole 39*b* of the disk 39. The engaging projection 43*a* is formed on the upper surface of the central block 43 of the fan assembly 42 and has the same shape as the engagement hole 39*b* of the inner blade 38 so as to engage with the engagement hole 39*b* of the disk 39. An engagement hole 43*b* is formed under the central block 43 of the fan assembly 42, and a transmission tongue 24*c* formed in the shape of a plate at the tip of the rotation transmission shaft 24 is inserted in this engagement hole 43*b*. The inner circumferential area of this engagement hole 43*b* is in a reversed-bowl-shape in order to facilitate engagement between the transmission tongue 24*c* of the transmission shaft 24 and the engagement hole 43*b* of the fan assembly 42.

Two vanes 44 project in the radial direction from the circumferential surface of the central block 43 of the fan assembly 42. These vanes 44 are inclined in the same direction as the cutting blades 40 of the inner blade 38.

An inner blade retaining plate 46 is installed on the inner surface of the shaver head 30. A head-equipped screw 48 is inserted into the central portion of this inner blade retaining plate 46, and the inner blade retaining plate 46 is mounted to the center of the inner surface of the shaver head 30 by the screw 48.

Furthermore, holes 51 which positionally correspond to the through-holes 31 of the shaver head 30 are formed in the inner blade retaining plate 46. These holes 51 allow the rotation transmission shafts 24 to pass through and also whiskers which have been cut by the blade 36 and 38 to drop downward or toward the shaver housing 12.

The inner blade retaining plate 46 forms an integral unit with the shaver head 30 via the screw 48 so as to prevent the shaving units 34 and the fan assemblies 42 from falling off when the shaver head 30 is removed from the shaver housing 12.

A space 28 is formed at the center of and between the first blade holding plate 26 and second blade holding plate 27 by a recessed area 26*a* formed in the first blade holding plate 26 and a projecting area 27*a* formed in the second blade holding plate 27.

The projecting area 27*a* of the second blade holding plate 27 has a through-hole 27*b*, and a shaver head supporting member 60 is inserted in this through-hole 27*b* so that the tip end of the shaver head supporting member 60 protrudes from this through-hole 27*b*. The shaver head supporting member 60 is prevented from slipping out of this through-hole 27*b* of the holding plate 27 by a flange which is formed around the outer circumference of the lower end of the shaver head supporting member 60. The shaver head supporting member 60 is urged towards the shaver head 30 by a spring 62 which is installed inside the space 28 formed between the holding plates 26 and 27. The tip end of the shaver head supporting member 60 is formed in hemispherical shape so that the hemispherical end of the shaver head supporting member 60 is in contact with the flat head of the head-equipped screw 48.

As a result, when force is applied onto the shaver head 30, the shaver head 30 may swivel or pivot in any direction about the hemispherical end of the shaver head supporting member 60. When a force which is greater than the spring force of the spring 62 is applied onto the shaver head 30, the shaver head 30 may be depressed inwardly or towards the shaver housing 12 together with the shaver head supporting member 60.

Furthermore, a bellows-form cushion element 64 that is used as an elastic cylinder is installed around the entire circumference of the shaver so as to be installed between the opening 12*a* of the shaver housing 12 and the shaver head 30.

More specifically, the cushion element 64 is in a tubular or cylindrical form, and the upper portion thereof is folded back toward the center of the opening 12*a* of the shaver housing 12. The bottom end of the bellows-form cushion element 64 is securely clamped between the inner circumference of the rim of the opening 12*a* of the shaver housing 12 and the outer circumference of the first blade holding plate 26, and the lower end of the folded-back part of the upper portion of the cushion element 64 is securely clamped between the inner circumference of the first blade holding plate 26 and the outer circumference of the second blade holding plate 27.

The cushion element 64 is made of rubber, a synthetic resin, etc. and is capable of expansion/contraction and deformation. Accordingly, when the force applied onto the shaver head 30 to swivel the shaver head 30 is removed, the shaver head 30 is restored to its neutral position, which is as shown in FIG. 1, by the elasticity of the cushion element 64.

Shaver head guides 66 are formed at the middle point of each of the three sides of the substantially triangular second blade holding plate 27. The shaver head guides 66 help the shaver head 30 guiding on and off the second blade holding plate 27 that is provided in the shaver body 12, and they guide the shaver head 30 during the pivot and inwardly depression movements of the shaver head 30. FIG. 1 shows one of three shaver head guides 66.

The more specific structure of the shaver head guides 66 will be described below.

An upright portion 68 which projects toward the shaver head 30 is formed at the middle point of each side of the triangle shape second blade holding plate 27. Only one upright portion 68 is shown in FIG. 1. The outside or circumferential surface of the upright portion 68 is partially closed off so as to have a through-hole 68*a* therein which opens toward the outside (upper right direction in FIG. 1).

The upper portion of a guide pin 69, which is the letter P-shape in cross section as shown in FIG. 1, protrude from the through-hole 68*a* in a manner that the pin 69 is prevented from slipping out of the through-hole 68*a*. More specifically, the guide pin 69 (only one out of three pins is shown in FIG. 1 as mentioned above) is pressed by a spring 70 (used as pressing members) outwardly so that the upper portion is pressed to protrude from the through-holes 68*a* though the lower portion of the pin 69 is caught by the edge of the hole 68*a* so that the pin 69 is prevented from slipping out of the hole 68*a*.

On the other hand, three (3) guide grooves 30*b* (only one shown) are formed in the corresponding positions in the inside wall surfaces of the shaver head 30. The upper portion of the P-shaped pin 69 is, as described above, pressed by the spring 70 so as to enter into the guide groove 30*b*. An engaging claw 30*c* is formed at the bottom end of each guide groove 30*b* so that the engaging claw 30*c* engages with the corresponding guide pin 69 to hold the shaver head 30 on the shaver main body 12. Accordingly, during pivoting and inward motions of the shaver head 30, the shaver head 30 can pivot and be depressed inward with the guide grooves 30*b* guided by the guide pins 69.

The guide pins 69 inserted into the guide grooves 30*b* are prevented from slipping out by the engaging claws 30*c*. When, however, the shaver head 30 is pulled upwardly (i.e., in the direction shown by arrow H in FIG. 1), the tip ends of the guide pins 69 retract into the through-holes 68*a* so that the shaver head 30 is removed from the shaver main body 12.

As seen from above, the shaver head 30 is supported by the shaver head supporting member 60, the cushion element 64 and the rotation transmission shafts 24. Accordingly, when the shaver head 30 swivels and is depressed, the shaver head 30 is pressed toward its neutral position which is the position shown in FIG. 1 by the spring 62 provided under the shaver head supporting member 60, by the cushion element 64 and by the springs 21 provided inside of the rotation transmission shafts 24.

The operation of the electric shaver thus constructed will be described below.

First, the power of the electric shaver 10 is switched on, and the shaver is moved while the outer blades 36 of the shaver head 30 are held against the skin, so that whiskers are shaved. In other words, whiskers enter the radial slits 37*a* in the shaving surfaces 37 of the outer blades 36, and the whiskers which have thus entered the slits are sheared off by the outer blades 36 and the cutting blades 40 of the inner blades 38 which are rotated by the motor 16.

The cut whiskers drop downward as if being sucked into the interior of the shaver housing 12 by the vanes 44 of the fan assemblies 42 which rotate together with the inner blades 38. When whiskers have accumulated on the second blade holding plate 27, the shaver head 30 is removed, and the whiskers on the blade holding plate 27 are removed.

The shaver head 30 is supported at its center; in other words, the shaver head 30 is supported on the hemispherical apex of the shaver head supporting member 60 via the head-equipped screw 48. Accordingly, during shaving, the shaver head 30 can be depressed inwardly towards the shaver housing 12 at any point around its circumference or the head 30 swivels, so that the shaving surface 30*a* is inclined so as to conform to the curvature of the skin. Thus, proper inclination of the shaving surface 30*a* to fit facial configuration is obtainable. In addition, by overcoming the force of the spring 62, the shaver head 30 itself, as a whole, can be depressed inwardly toward the shaver housing 12 or in the direction of the axis of the screw 48 together with the shaver head supporting member 60.

As seen from the above, not only the shaver head 30 itself, as a whole, can be depressed inward in the direction of the axis of the screw 48, but it also is depressed any point on the circumferential edge of the shaver head 30, swiveling about the shaver head supporting member 60. Thus, the inclination of the shaving surface 30*a* of the shaver head 30 can be altered at any desired angle and depth.

In order to obtain these movements of the shaver head 30, it may be preferable to install the outer blades 36 integrally fixed in place on the shaver head 30. However, it would be ideal to design it so that the outer blades 36 can be depressed and are inclinable in conformity of the facial configuration when shaving at an even closer conformity to the facial configuration is desired. Thus, the shaver of the present invention is constructed to realize this.

More specifically, the outer blades 36 mounted in the shaver head 30 in a manner that they are regulated by the tongues 31*b* so that the outer blades are depressed inward by a distance equal to H–D, or outer blades 36 are mounted so that the angles of the shaving surfaces 30*a* can be altered. The distance of the inward depression of the inner blades 38 is also regulated by the inner blade retaining plate 46 which is fastened on the inner surface of the shaver head 30 by the head-equipped screw 48.

Next, the structure of the trimmer unit 72 will be described.

A seen in FIG. 1, the trimmer unit 72 is installed in an open recess 10B formed on the back of the electric shaver 10. The upper part of a trimmer base plate 74 which is bent into shallow "L" curve (when viewed from the side) is fastened to a shaft 73 that is fixed to the shaver housing 12. Thus, the trimmer base plate 74 may close the open recess 10B of the shaver housing 12 as seen from FIG. 1. The trimmer base plate 74 is provided with an immovable blade 76*a* and a movable blade 76*b* at the lower end, and a driving lever 78 which is used to move the movable blade 76*b* is fastened to the back surface of the trimmer base plate 74. Furthermore, two side walls 75 are formed on both sides of the trimmer base plate 74, and guide grooves 75*a* which are respectively in a form of a shallow "L" curve are formed on the inner surfaces of the side walls 75.

A slide grip 80 is installed so as to be under the trimmer base plate 74 (in FIG. 1) so as to cover the open recess 10B. The upper part of this slide grip 80 extends to enter the area behind the trimmer base plate 74 (or located between the shaver housing 12 and the base plate 74), and a driving lever 82 which pivots about a shaft 81 is installed on the back surface in this area. The upper end of this driving lever 82 protrudes toward the rear surface (or toward the right in FIG. 1). Operating arms 82 that are engaged with the guide grooves 75*a* are provided on the upper end of the slide grip 80.

Figure 5:
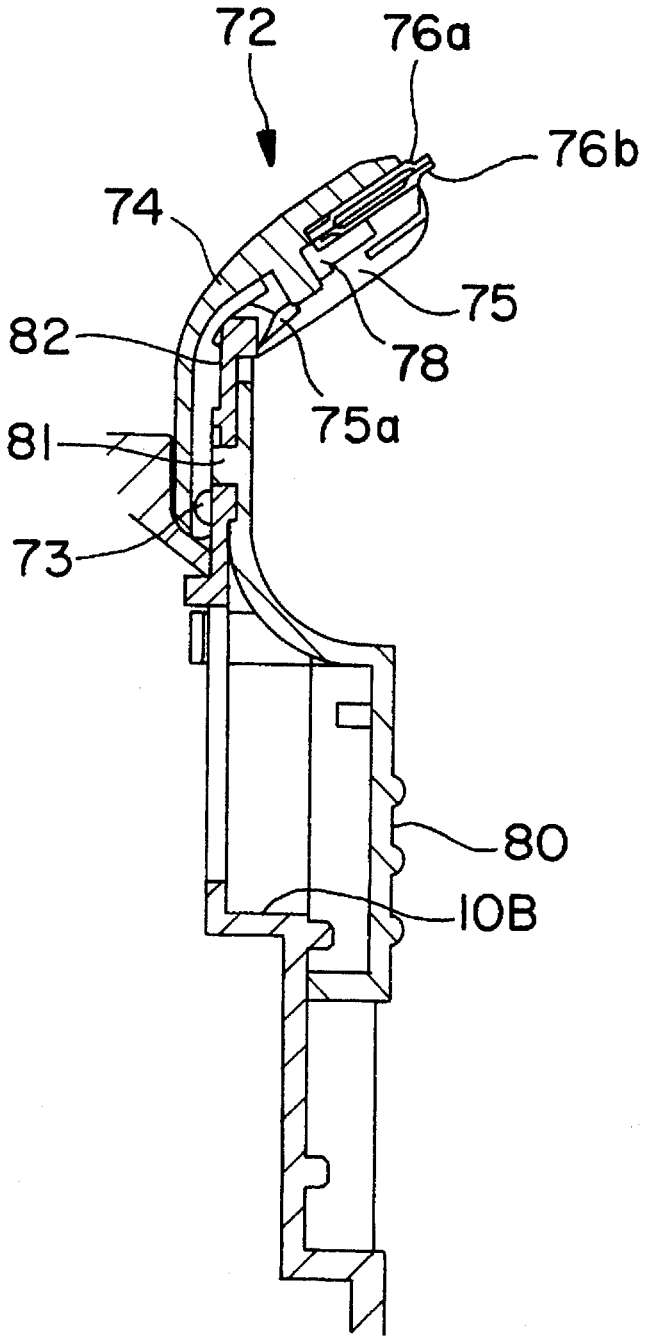
FIG. 5 is a sectional explanatory diagram which shows the trimmer unit in an erect state.

When the slide grip 80 is pushed upward, the operating arms 82 cause the trimmer base plate 74 to rotate upward about the shaft 73, so that the immovable blade 76*a* and movable blade 76*b* on the lower end of the trimmer base plate 74 are oriented obliquely upward as illustrated in FIG. 5. When these movements are made, the driving lever 78 and the driving lever 82 are engaged with each other. The driving lever 82 oscillates via a linkage (not illustrated) with the motor 16.

In the embodiment described above, it is not absolutely necessary that the shaver head supporting member 60 which supports the shaver head 30 be depressed. For example, it is possible to form the shaver head supporting member 60 as an integral element of the second blade holding plate 27 at the center of the second blade holding plate 27.

Moreover, it can be designed so that the shaver head 30 is kept urged and supported only by the spring force of the springs 21 installed in the rotation transmission shafts 24 without using the cushion element 64.

Furthermore, it would also be possible to design it so that the shaver head 30 is supported only by the cushion element 64 and by the respective rotation transmission shafts 24, not using the shaver head supporting member 60. In this case, the cushion element 64 and the rotation transmission shafts 24 function as the supporting members.

Moreover, there are no restrictions on the shape of the cushion element 64 as long as the cushion element is deformable or elastic. In other words, the cushion element 64 can be in a deformable plate- or block-form instead of bellows-form.

Furthermore, in the above embodiment, three shaving units 34 are installed in the shaver head 30. However, it is possible to install only a single shaving unit 34, and there are no restrictions on the shapes of the inner and outer blades.

Various aspects on the preferred embodiments of the present invention are described above. However, the present invention should not be limited to the embodiments described above, and it goes without saying that various modifications may be made without departing from the spirit and scope of the present invention.

As seen from the above, according to the present invention, the shaver head can pivot and be depressed towards the inside of the shaver housing, and the shaving surface of the shaver head can also be inclined. Accordingly, the electric shaver of the present invention shows a number of conspicuous effects such that shaving can be accomplished in conformity to the facial configuration.

I claim:

1. An electric shaver comprising:

a shaver housing containing a power source therein;

a shaver head provided at one end of said shaver housing, said shaver head including shaving units each comprising an outer blade and an inner blade which is rotated by said power source and in close contact with an inner surface of said outer blade;

a blade holding plate which is provided at one end of said shaver housing;

a shaver head supporting member which pivotally supports said shaver head on said blade holding plate;

a plurality of driving means which are rotated by receiving a transmitted rotation of said power source;

rotation transmission shafts which pass through through-holes formed in said blade holding plate and thus protrude from said blade holding plate, said transmission shafts being connected, at one end thereof, to said driving means in such a manner that said rotation transmission shafts may pivot, may advance and withdraw a prescribed distance in an axial direction of said transmission shafts, and may be rotated about axes of said transmission shafts by said driving means, and, at other ends thereof, to said inner blades so as to rotate said inner blades; and pressing means which press said rotation transmission shafts toward said shaving units.

2. An electric shaver according to claim 1 characterized in that said shaver head supporting member is provided so as to protrude from a center of said blade holding plate and has a tip portion that contacts a projecting element provided on an inner surface of said shaver head so as to pivotally support said shaver head.

3. An electric shaver according to claim 2 characterized in that said shaver head supporting member is provided on said blade holding plate via a pressing means so that said shaver head supporting member can be depressed inwardly against a pressing force of said pressing means.

4. An electric shaver according to claim 1, 2 or 3 characterized in that said shaver is further provided with head guides which guide a pivot motion of said shaver head.

5. An electric shaver according to claim 4 characterized in that said head guides are comprised of a plurality of guide grooves which are formed on an inner surface of said shaver head and guide pins with tip end thereof being inserted into said guide grooves.

6. An electric shaver according to claim 5 characterized in that said guide pins are provided so that tip ends of said guide pins protrude from through-holes formed in said blade holding plate by being pressed by pressing means, and projecting parts formed on an inner surface of said shaver head contact said tip ends of said guide pins so that said shaver head is prevented from slipping out of said shaver housing, said guide pins being retracted into said through-holes when said shaver head is pulled in a direction that said shaver head is detached from said shaver housing.

7. An electric shaver according to claim 1 characterized in that each of said driving means comprises a tube member formed with a plurality of slits that extend in an axial direction of said tube member, and projections which are formed on said rotation transmission shafts are loosely inserted into said slits of said tube member, said rotation transmission shafts and said driving means being connected to each other in such a manner that said rotation transmission shafts may pivot, may advance and withdraw a prescribed distance in an axial direction of said transmission shafts, and may be rotated about axes of said transmission shafts by said driving means.

8. An electric shaver according to claim 2 characterized in that said inner blades are covered by an inner blade retaining plate which has through-holes through which said rotation transmission shafts pass so as to prevent said inner blades from falling out of said shaver head, said inner blade retaining plate being screw-fastened to said shaver head by a head-equipped screw so that said inner blade retaining plate is removable, and a head part of said head-equipped screw constitutes said projecting element provided on said inner surface of said shaver head.

9. An electric shaver according to claim 7 characterized in that each of said outer blades is provided with a flange which protrudes outwardly from a circumference of each of said outer blades, through-holes are formed in said shaver head so that said outer blades are inserted thereinto, and said outer blades are held in said shaver head in such a manner that said outer blades are movable in an axial direction of each of said tube members.

10. An electric shaver according to claim 1 characterized in that an elastic cylinder is provided between said shaver head and said shaver housing.

11. An electric shaver according to claim 10 characterized in that said elastic cylinder is a bellows-form cover.

12. An electric shaver comprising:

a shaver housing containing therein a driving source;

a shaver head mounted on said shaver housing with a bellows-form cushion element in between, said shaver head containing shaving units each consisting of an outer blade and an inner blade that is rotated by said driving source;

a blade holding plate provided inside one end of said housing;

a shaver head supporting member for pivotally supporting said shaver head on said blade holding plate;

rotation transmission shafts with one end of each of said shafts passing a hole formed in said blade holding plate, each of said rotation transmission shafts being connected at said one end to one of said inner blades and being able to pivot, move in an axial direction of said each of said rotation transmission shafts and rotates about an own axis by said driving source; and a pressing means installed in each of said rotation transmission shafts so as to press said rotation transmission shaft toward said inner blade.

* * * * *